US009174821B2

(12) United States Patent
Izumichi

(10) Patent No.: US 9,174,821 B2
(45) Date of Patent: Nov. 3, 2015

(54) SHEET FOLDING DEVICE HAVING SHEET RETAINING MECHANISM

(71) Applicant: Kyocera Document Solutions Inc., Osaka (JP)

(72) Inventor: Sachio Izumichi, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 58 days.

(21) Appl. No.: 14/048,717

(22) Filed: Oct. 8, 2013

(65) Prior Publication Data

US 2014/0100100 A1 Apr. 10, 2014

(30) Foreign Application Priority Data

Oct. 10, 2012 (JP) ..... 2012-224757

(51) Int. Cl.

| | |
|---|---|
| ***B65H 37/06*** | (2006.01) |
| ***B65H 45/04*** | (2006.01) |
| ***B65H 45/14*** | (2006.01) |
| ***B65H 45/18*** | (2006.01) |

(52) U.S. Cl.

CPC ..... *B65H 45/04* (2013.01); *B65H 45/144* (2013.01); *B65H 45/18* (2013.01); *B65H 2801/27* (2013.01)

(58) Field of Classification Search

CPC ..... B65H 37/06
USPC ..... 270/32, 37, 45, 49, 50; 493/444, 445
See application file for complete search history.

(56) References Cited

U.S. PATENT DOCUMENTS

| | | | | |
|---|---|---|---|---|
| 5,048,809 | A * | 9/1991 | Tebbe et al. | 270/45 |
| 7,111,837 | B2 * | 9/2006 | Itou et al. | 270/45 |
| 8,505,899 | B2 * | 8/2013 | Kawatsu et al. | 270/39.01 |
| 8,900,110 | B2 * | 12/2014 | Jung | 493/360 |
| 2011/0236108 | A1 * | 9/2011 | Izumichi et al. | 400/578 |
| 2011/0237416 | A1 * | 9/2011 | Izumichi et al. | 493/454 |
| 2013/0087965 | A1 * | 4/2013 | Shimizu | 270/45 |

FOREIGN PATENT DOCUMENTS

| | | | |
|---|---|---|---|
| DE | 2 152 078 | | 5/1972 |
| JP | 60-015358 | | 1/1985 |
| JP | 60015358 | A * | 1/1985 |
| JP | 2010-100347 | | 5/2010 |
| JP | 2010260671 | | 11/2010 |

OTHER PUBLICATIONS

European Search Report—Application No. 13187350.7, dated Jan. 23, 2014. (7 pages).

* cited by examiner

*Primary Examiner* — Patrick Mackey
(74) *Attorney, Agent, or Firm* — K&L Gates LLP

(57) ABSTRACT

A sheet folding device includes a first folding unit, a retreat path, a sheet retaining mechanism, and a second folding unit. The first folding unit forms a first fold in a sheet. The retreat path is entered by the sheet having the first fold formed by the first folding unit, and has a stop portion to be contacted by the first fold. The sheet retaining mechanism moves a movable member with respect to the sheet that enters the retreat path, and regulates movement of the sheet in the retreat path in a direction of thickness of the sheet. The second folding unit forms a second fold in the sheet having the first fold while allowing the sheet that has contacted the stop portion to exit the retreat path.

7 Claims, 8 Drawing Sheets

SHEET FOLDING DEVICE HAVING SHEET RETAINING MECHANISM

INCORPORATION BY REFERENCE

This application is based upon, and claims the benefit of priority from, corresponding Japanese Patent Application No. 2012-224757 filed in the Japan Patent Office on Oct. 10, 2012, the entire contents of which are incorporated herein by reference.

BACKGROUND

The present disclosure relates to a sheet folding device that folds a sheet having an image formed thereon, a sheet post-processing apparatus including the sheet folding device, and an image forming apparatus.

A sheet folding device including a first folding roller, a second folding roller, a conveying path, and a third folding roller is known. The first folding roller and the second folding roller perform a first folding process on the paper (sheet). The conveying path has a stopper that is contacted by the sheet that has been subjected to the first folding process. The second folding roller and the third folding roller allow the sheet, that has been subjected to the first folding process, to enter the conveying path, and perform a second folding process on the sheet. The sheet that has been subjected to the first folding process is tightly folded in its center, and is gently curved and bulged at both ends. Therefore, the conveying path (retreat path) is narrowed at a portion from which the center of the sheet enters. This can stabilize the behavior of the sheet that enters the retreat path.

The sheet folding device described above does not take into account the fact that the overall thickness of folded sheets varies depending on the number of sheets that enter the retreat path. For example, if the retreat path is set to a thickness that allows entry of one sheet that has been subjected to the first folding process, the retreat path cannot therefore accommodate two or more stacked and folded sheets. Also, the sheet folding device described above does not take into account the fact that the thickness of the sheet itself varies from time to time.

Additionally, when the space inside the retreat path is set to accommodate the maximum thickness of sheets that will enter the retreat path, if a thin sheet enters the retreat path, the thin sheet that has been folded may bulge inside the retreat path, or the first folded portion of the sheet that contacts the stopper may move randomly (i.e., behave unstably) inside the retreat path. If this sheet is then subjected to the second folding process, the position of the second fold of the sheet may deviate or the second fold may be skewed.

SUMMARY

A sheet folding device according to an embodiment of the present disclosure includes a first folding unit, a retreat path, a sheet retaining mechanism, and a second folding unit. The first folding unit forms a first fold in a sheet. The retreat path is entered by the sheet having the first fold formed by the first folding unit, and has a stop portion to be contacted by the first fold. The sheet retaining mechanism moves a movable member with respect to the sheet that enters the retreat path, and regulates movement of the sheet in the retreat path in a direction of thickness of the sheet. The second folding unit forms a second fold in the sheet having the first fold while allowing the sheet that has contacted the stop portion to exit the retreat path.

A sheet post-processing apparatus according to another embodiment of the present disclosure includes the sheet folding device described above.

An image forming apparatus according to another embodiment of the present disclosure includes the sheet folding device described above.

Additional features and advantages are described herein, and will be apparent from the following Detailed Description and the figures.

DETAILED DESCRIPTION

Figure 1:
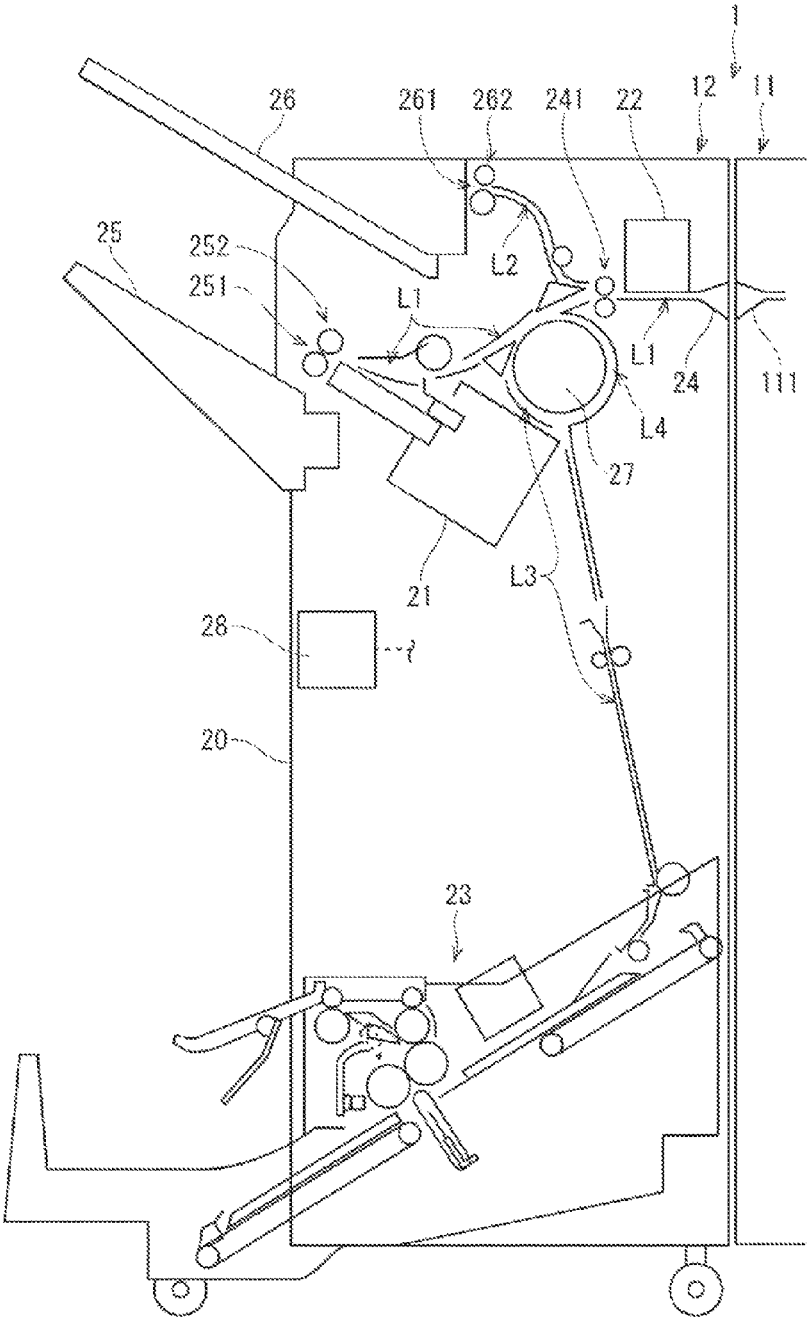
FIG. 1 is a cross-sectional view schematically illustrating an image forming apparatus main body and a sheet post-processing apparatus that are included in an image forming apparatus according to an embodiment of the present disclosure.

An embodiment of the present disclosure will now be described with reference to the drawings. FIG. 1 is a cross-sectional view schematically illustrating an image forming apparatus main body 11 and a sheet post-processing apparatus 12 that are included in an image forming apparatus 1 according to an embodiment.

As illustrated in FIG. 1, the image forming apparatus 1 includes the image forming apparatus main body 11 that forms an image on a sheet S, and the sheet post-processing apparatus 12 that performs predetermined post-processing on the sheet S having the image formed (printed) thereon.

The image forming apparatus main body 11 includes an image forming unit (not shown) that forms an image on the sheet S, such as paper, and a main-body discharge unit 111 that discharges the sheet S having the image formed thereon by the image forming unit to the sheet post-processing apparatus 12 or the like.

The sheet post-processing apparatus 12 introduces, into a housing 20, the sheet S that has been subjected to image formation by the image forming unit and discharged from the main-body discharge unit 111. Then, the sheet post-processing apparatus 12 performs post-processing, such as a stapling process, a punching process, and a folding process, on the sheet S.

The sheet post-processing apparatus 12 includes a stapling device 21 that stacks and staples a plurality of sheets S, a punching device 22 that performs a predetermined punching process on the sheets S, and a sheet folding device 23 that performs a folding process on the sheets S. The sheet post-processing apparatus 12 further includes an introducing unit 24 through which a sheet S discharged from the main-body discharge unit 111 of the image forming apparatus main body 11 is introduced, a main discharge tray 25 that receives the sheet S discharged from a main discharging unit 251, a sub-discharge tray 26 that receives the sheet S discharged from a sub-discharging unit 261, a retreat drum 27 that allows the sheet S to temporarily withdraw into a predetermined conveying path, a control device 28 that controls each device and mechanism, and various switching members and rollers.

The introducing unit 24 and the main discharging unit 251 communicate with each other via a first conveying path L1. A second conveying path L2 branched off the first conveying path L1 is connected to the sub-discharging unit 261. A third conveying path L3 branched off the first conveying path L1 is connected to the sheet folding device 23. A fourth conveying path L4 branched off the third conveying path L3 is curved around the periphery of the retreat drum 27 and connected to the first conveying path L1.

The sheet S introduced from the introducing unit 24 is fed to the downstream side by a first intermediate roller pair 241. A main discharging unit roller pair 252 that feeds the sheet S to the main discharge tray 25 is provided at a terminal end of the first conveying path L1. When feeding the sheet S to the stapling device 21, the rollers of the main discharging unit roller pair 252 are spaced apart to release the nip therebetween. The main discharge tray 25 primarily receives a bundle of sheets S that have been stapled by the stapling device 21. The sheets S that are not post-processed or that have only been subjected to a punching process may be received by the main discharge tray 25.

A sub-discharging unit roller pair 262 that feeds a sheet S to the sub-discharge tray 26 is provided at a terminal end of the second conveying path L2. The sub-discharge tray 26 primarily receives sheets S that are discharged without being post-processed by the sheet post-processing apparatus 12, or sheets S that have been subjected to only a punching process.

When a stapling process is sequentially applied to a plurality of bundles of sheets S, the first sheet S of a bundle of sheets S is wound around the surface of the retreat drum 27 and waits during the stapling process of the previous bundle of sheets S.

The stapling device 21 is located on the downstream side (i.e., near the terminal end) of the first conveying path L1 and below the first conveying path L1. The stapling device 21 performs a stacking process that stacks a plurality of sheets S to form a bundle of the sheets S, and also performs a stapling process that staples the bundle of the stacked sheets S.

The punching device 22 is located between the introducing unit 24 and the first intermediate roller pair 241, and faces the first conveying path L1 from above. The punching device 22 performs a punching process on a sheet S fed along the first conveying path L1.

Figure 2:
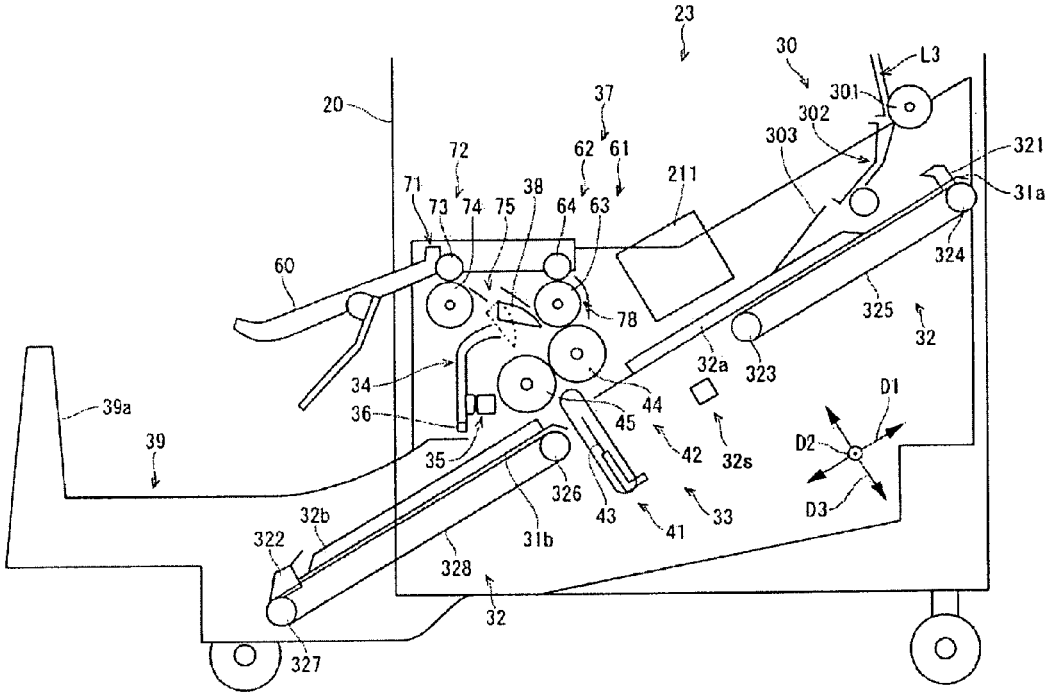
FIG. 2 is a cross-sectional view schematically illustrating a sheet folding device included in the sheet post-processing apparatus according to an embodiment of the present disclosure.
Figure 3:
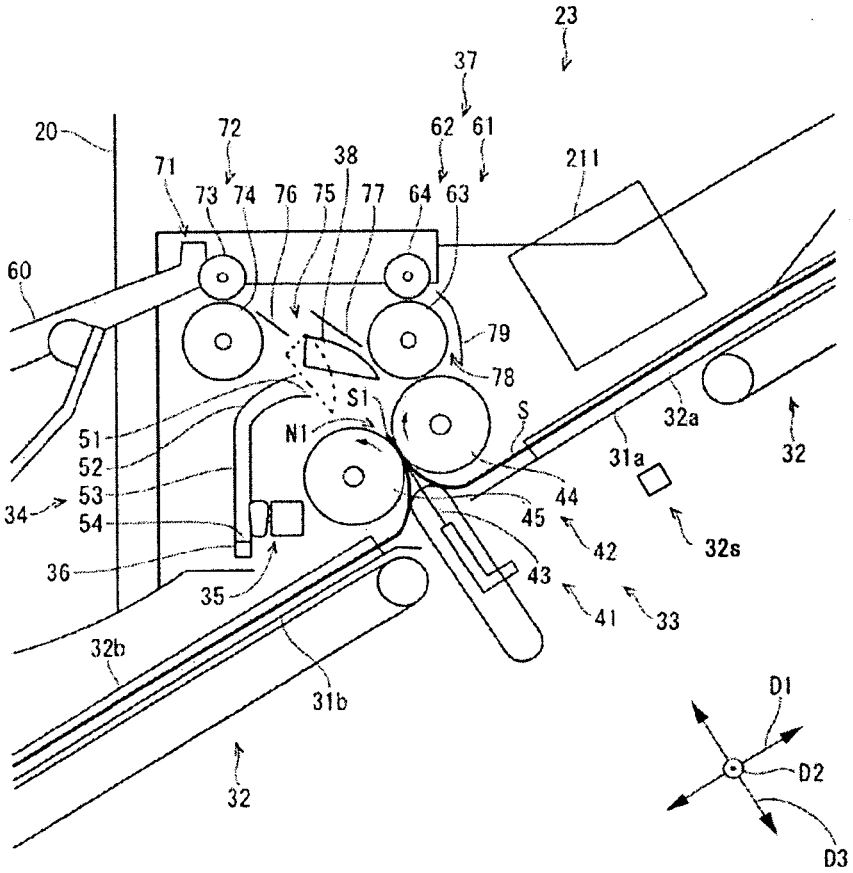
FIG. 3 is a cross-sectional view schematically illustrating a process of forming a first fold in a sheet in the sheet folding device according to an embodiment of the present disclosure.
Figure 4:
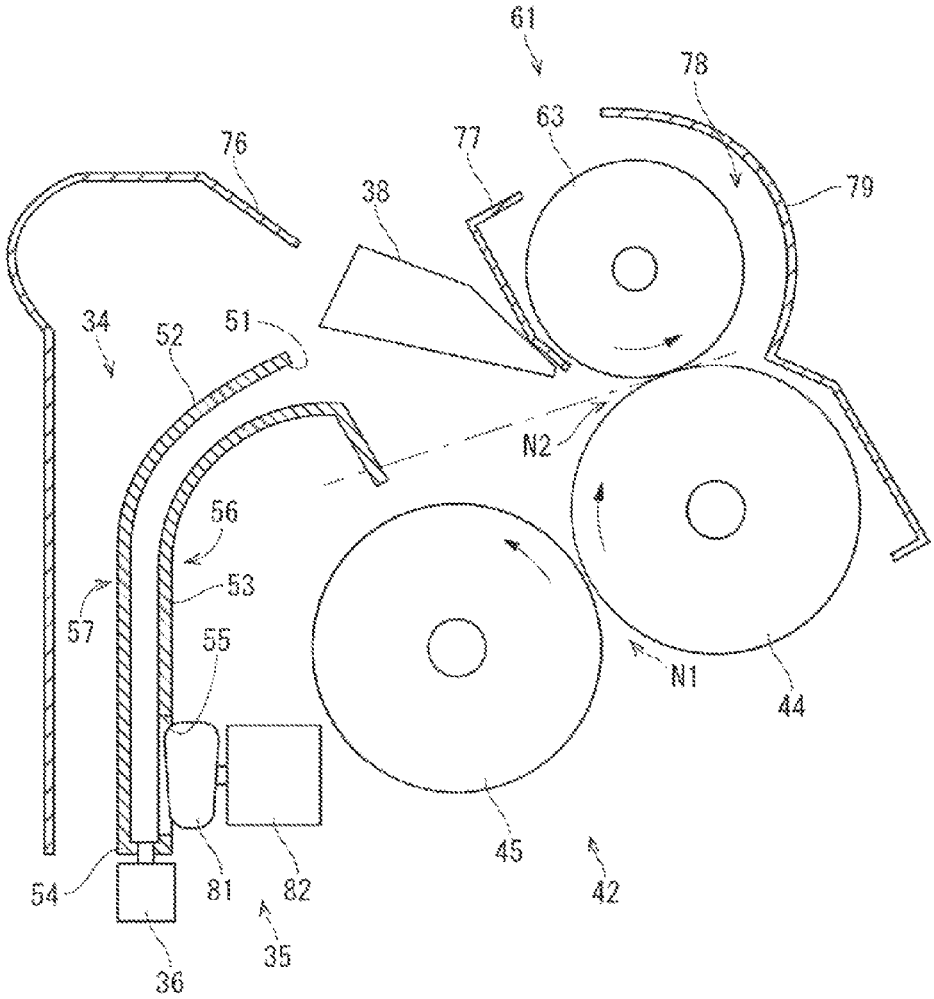
FIG. 4 is an enlarged cross-sectional view schematically illustrating the sheet folding device according to an embodiment of the present disclosure.

The sheet folding device 23 in the sheet post-processing apparatus 12 of an embodiment will now be described with reference to FIGS. 1 to 4. FIG. 2 is a cross-sectional view schematically illustrating the sheet folding device 23 in the sheet post-processing apparatus 12 according to an embodiment. FIG. 3 is a cross-sectional view schematically illustrating a process of forming a first fold S1 in a sheet S in the sheet folding device 23 according to an embodiment. FIG. 4 is an enlarged cross-sectional view schematically illustrating the sheet folding device 23 according to an embodiment. In the following description, for convenience, the term "sheet S" may refer either to a single sheet S or to a bundle of sheets S (including those that have been subjected to a stapling process).

As illustrated in FIGS. 1 and 2, the sheet folding device 23 according to an embodiment is located in a lower part of the housing 20 of the sheet post-processing apparatus 12. Specifically, the sheet folding device 23 is positioned on the downstream side of the third conveying path L3. For example, when the user selects a folding process, the sheet folding device 23 performs a folding process, such as a double or triple folding process, on the introduced sheet S.

The sheet folding device 23 includes a sheet introducing path 30 continuous from the downstream end of the third conveying path L3, an upstream sheet holding member 31*a* and a downstream sheet holding member 31*b* on which a sheet S introduced from the sheet introducing path 30 is placed, and aligning units 32 that align the sheet S placed on the sheet holding members 31*a* and 31*b*.

The sheet folding device 23 further includes a first folding unit 33 that forms the first fold S1 in the sheet S, a retreat path 34 to be entered by the sheet S having the first fold S1 formed by the first folding unit 33, a sheet retaining mechanism 35 that regulates movement of the sheet S that has entered the retreat path 34 in the direction of thickness of the sheet S, a sensor 36 (detector) that detects the entry of the sheet S having the first fold S1 into the retreat path 34, and a second folding unit 37 that forms a second fold S2 in the sheet S having the first fold S1 formed by the first folding unit 33.

The sheet folding device 23 further includes a destination switching member 38 that switches the destination of the sheet S having the first fold S1 formed by the first folding unit 33, and a lower discharge tray 39 that receives the sheet S discharged from a lower discharging unit 71.

As illustrated in FIG. 2, the sheet introducing path 30 is a path for introducing the sheet S that has been fed along the third conveying path L3 into the sheet folding device 23. The sheet introducing path 30 includes an introducing roller pair 301 that feeds the sheet S into the sheet folding device 23, and introducing guides 302 and 303 that guide the introduction of the sheet S.

The upstream sheet holding member 31*a* and the downstream sheet holding member 31*b* are formed, for example, by plate-like members, and are arranged in line diagonally from the upper right to the lower left of the interior of the sheet folding device 23. Specifically, the upstream sheet holding member 31*a* is positioned upstream of an extruding mechanism 41 (described below) in a sheet conveyance direction D1 illustrated in FIG. 2. The downstream sheet holding member 31*b* is spaced from the upstream sheet holding member 31*a* and positioned downstream of the extruding mechanism 41 in the sheet conveyance direction D1. A second stapling device 211 that staples a bundle of sheets S subjected to a folding process by the first folding unit 33 is positioned above the upstream sheet holding member 31*a*.

The aligning units 32 include an extruding member 321 and a receiving member 322 that align the leading edge and the trailing edge of the sheet S on the sheet holding members 31*a* and 31*b* in the conveyance direction D1 of the sheets S, and width aligning members 32*a* and 32*b* that align the side edges of the sheet S in a direction D2 orthogonal to the conveyance direction D1 of the sheet S.

The extruding member 321 is attached to an upstream belt 325 stretched between an upstream driving pulley 323 and an upstream driven pulley 324 located below the upstream sheet holding member 31*a*. The receiving member 322 is attached to a downstream belt 328 stretched between a downstream driving pulley 326 and a downstream driven pulley 327 located below the downstream sheet holding member 31*b*. By moving the extruding member 321 and the receiving member 322 to fit the size of the sheet S (i.e., the length of the sheet S in the conveyance direction D1), the sheet S on the sheet holding members 31*a* and 31*b* is aligned in the conveyance direction D1 (i.e., in the length direction of the sheet S).

The width aligning members 32*a* and 32*b* are located on the upstream sheet holding member 31*a* and the downstream sheet holding member 31*b*, respectively, and each have portions spaced apart in the width direction D2. The width aligning members 32*a* and 32*b* are arranged in a pair in a direction parallel to the conveyance direction D1 of the sheet S. With a rack-and-pinion mechanism (not shown), the pair of width aligning members 32*a* and 32*b* moves to fit the size of the sheet S (i.e., the length of the sheet S in the width direction D2). Thus, the width aligning members 32*a* and 32*b* perform width alignment and skew correction of the sheet S.

As illustrated in FIGS. 2 and 3, the first folding unit 33 includes the extruding mechanism 41 that pushes out the sheet S, and a first folding roller pair 42 that forms the first fold S1 in the sheet S pushed out by the extruding mechanism 41.

The extruding mechanism 41 is positioned between the upstream sheet holding member 31*a* and the downstream sheet holding member 31*b* and below the first folding roller pair 42. The extruding mechanism 41 includes a blade member 43 that comes into contact with the lower surface of the sheet S. The extruding mechanism 41 includes a motor (not shown) and a power transmission mechanism (not shown) that move the blade member 43 in a direction D3 orthogonal to a plane (D1-D2) including the conveyance direction D1 and the width direction D2 of the sheet S. The blade member 43 pushes out and feeds the sheet S into a first nip N1 (described below).

The first folding roller pair 42 is composed of a common roller 44 and a first roller 45 positioned downstream of the common roller 44 in the conveyance direction D1 of the sheet S. The directions of axes of the common roller 44 and the first roller 45 are substantially parallel to the plane (D1-D2) including the conveyance direction D1 and the width direction D2 of the sheet S. The common roller 44 and the first roller 45 are rotationally driven by the motor (not shown) via the power transmission mechanism (not shown).

The common roller 44 and the first roller 45 form the first nip N1 therebetween into which the sheet S is fed by the blade member 43 (extruding mechanism 41). When the sheet S passes through the first nip N1 while being sandwiched thereat, the first fold S1 is formed in the sheet S.

As illustrated in FIGS. 2 to 4, the retreat path 34 is provided to allow the sheet S having the first fold S1 formed by the first folding unit 33 to enter and withdraw while bending. The retreat path 34 is positioned opposite the common roller 44 with the destination switching member 38 interposed therebetween. The retreat path 34 is curved along the periphery of the first roller 45.

The retreat path 34 has a sheet entrance 51 that opens toward the common roller 44, a curved portion 52 that is curved downward from the sheet entrance 51, a linear portion 53 that extends downward from the curved portion 52, a stop portion 54 that is formed at the lower end of the linear portion 53, and an opening 55 that is formed to pass through the linear portion 53.

The sheet S having the first fold Si enters the sheet entrance 51 with the first fold S1 first. The sheet entrance 51 is located below the destination switching member 38 and above a nip plane in a second nip N2 of a second folding roller pair 61. Note that the nip plane is a plane in the direction of the tangent to the second nip N2 (see a dot-and-dash line in FIG. 4).

The curved portion 52 and the linear portion 53 include an inner wall 56 and an outer wall 57 spaced apart and arranged in parallel (see FIG. 4). The inner wall 56 is adjacent to the first roller 45 and the outer wall 57 is adjacent to the lower discharge tray 39 (on the outside). The space between the inner wall 56 and the outer wall 57 is formed to accommodate the thickness of the maximum number of sheets S that can be subjected to a folding process by the sheet folding device 23. For example, when the folding process can be performed on one to five sheets S, the inner wall 56 and the outer wall 57 are arranged in parallel and the curved portion 52 and the linear portion 53 are formed to define a space that can accommodate the thickness of five folded sheets S (each having the first fold S1) or the thickness of ten sheets S.

The stop portion 54 is contacted by the first fold S1 of the sheet S that has entered (or has withdrawn into) the retreat path 34 (i.e., the curved portion 52 and the linear portion 53) from the sheet entrance 51. The stop portion 54 is located below the upstream end of the downstream sheet holding member 31*b*.

In the inner wall 56 of the linear portion 53, the opening 55 is located slightly above the stop portion 54 and formed to pass through the inner wall 56 toward the first roller 45. The opening 55 is formed into a shape (e.g., rectangle) and size that allows insertion of a movable member 81 of the sheet retaining mechanism 35.

As will be described in detail below, the sheet retaining mechanism 35 moves the movable member 81 with respect to the sheet S that enters the retreat path 34, so as to regulate movement of the sheet S in the retreat path 34 in the direction of thickness of the sheet S. This can prevent the folded sheet S from bulging in the retreat path 34, and can also prevent the position of the first fold S1 that has contacted the stop portion 54 from being unstable and randomly moving in the retreat path 34.

The second folding unit 37 illustrated in FIGS. 2 and 3 forms the second fold S2 in the sheet S having the first fold S1 while allowing the sheet S that has contacted the stop portion 54 to exit the retreat path 34. The second folding unit 37 includes the second folding roller pair 61 that forms the second fold S2 in the sheet S having the first fold S1, and a first auxiliary roller pair 62 that assists the discharge of the sheet S having the second fold S2 into the lower discharging unit 71.

The second folding roller pair 61 is composed of the common roller 44 described above, and a second roller 63 located above the common roller 44. As described above, the common roller 44 also serves as a roller of the first folding roller pair 42. The second roller 63 is rotationally driven by a motor (not shown) via a power transmission mechanism (not shown).

The common roller 44 and the second roller 63 form the second nip N2 (see FIG. 4) therebetween. When the sheet S having the first fold S1 passes through the second nip N2 while being sandwiched thereat, the second fold S2 is formed in the sheet S.

The first auxiliary roller pair 62 is located in the middle of a second discharge conveying path 78. The first auxiliary roller pair 62 is composed of the second roller 63 described above and a third roller 64 located above the second roller 63. As described above, the second roller 63 also serves as a roller of the second folding roller pair 61.

The destination switching member 38 turns to switch the destination of the sheet S having the first fold S1 formed by the first folding unit 33. Specifically, the destination switching member 38 switches the destination of the sheet S between the retreat path 34 and a first discharge conveying path 75. As will be described in detail below, a space surrounded by the common roller 44, the first roller 45, the second roller 63, the retreat path 34, and the destination switching member 38 is used as a space where the sheet S switched back from the retreat path 34 bends.

The lower discharge tray 39 is adjacent to the lower discharging unit 71. The lower discharge tray 39 has a wall portion 39*a* that stands upright at the downstream end thereof in the sheet discharging direction so as to receive the sheet S. A retaining member 60 is located above the lower discharge tray 39. The retaining member 60 holds the sheet S discharged from the lower discharging unit 71 from above.

The lower discharging unit 71 is provided with a lower discharging roller pair 72. The lower discharging roller pair 72 is composed of a first lower discharging roller 73 formed as a driven roller and movable in the vertical direction, and a second lower discharging roller 74 formed as a driving roller.

The first discharge conveying path 75 feeds the sheet S having only the first fold S1 from the first folding roller pair 42 to the lower discharging roller pair 72. The first discharge conveying path 75 is formed by a lower guide 76 and an upper guide 77.

The second discharge conveying path 78 feeds the sheet S having the first fold S1 and the second fold S2 from the second folding roller pair 61 to the lower discharging roller pair 72. The upstream side of the second discharge conveying path 78 is formed by an upstream guide 79 and the periphery of the second roller 63. The downstream side of the second discharge conveying path 78 is formed by the upper surface of the upper guide 77 of the first discharge conveying path 75.

Figure 5:
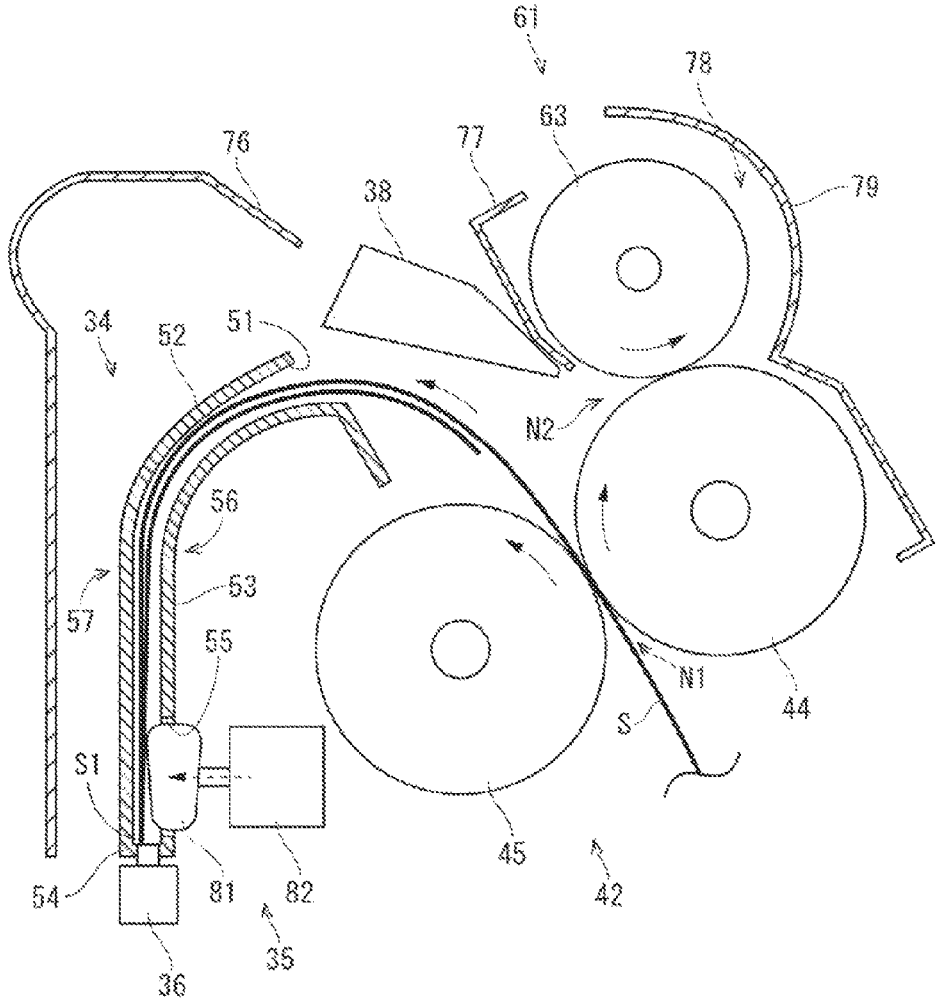
FIG. 5 is a cross-sectional view schematically illustrating a process of forming a second fold in the sheet having the first fold, the process following the process illustrated in FIG. 3.
Figure 6:
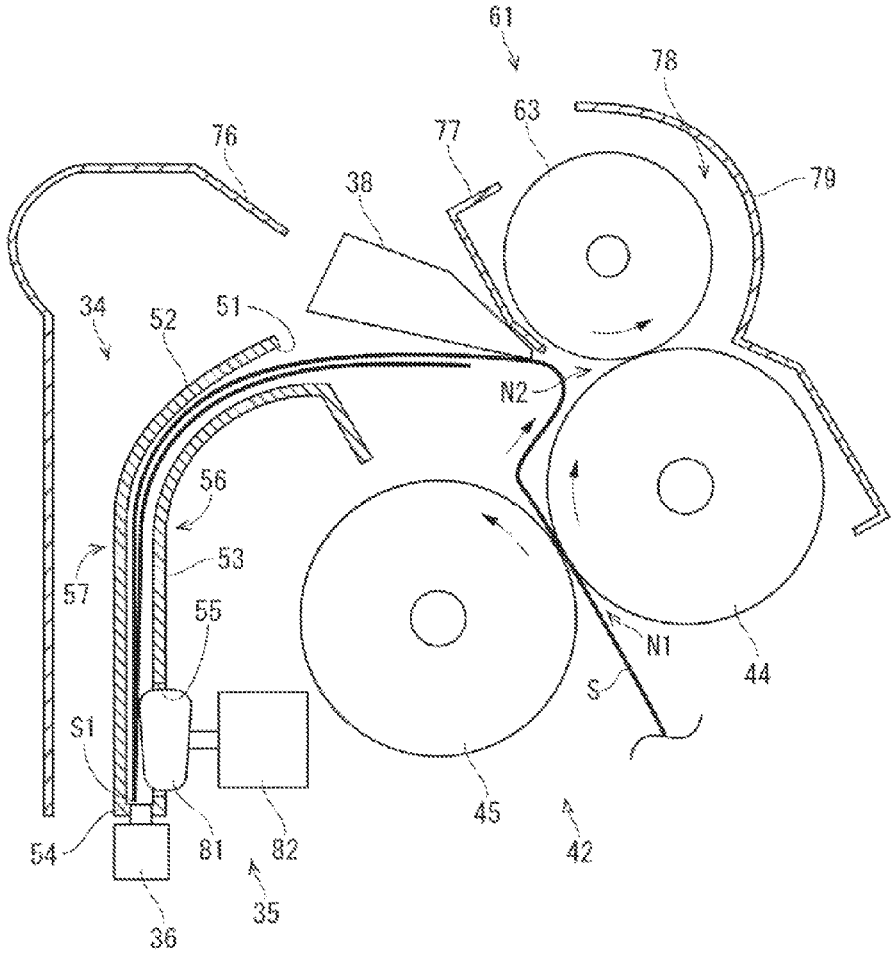
FIG. 6 is a cross-sectional view schematically illustrating a state following the process illustrated in FIG. 5.
Figure 7:
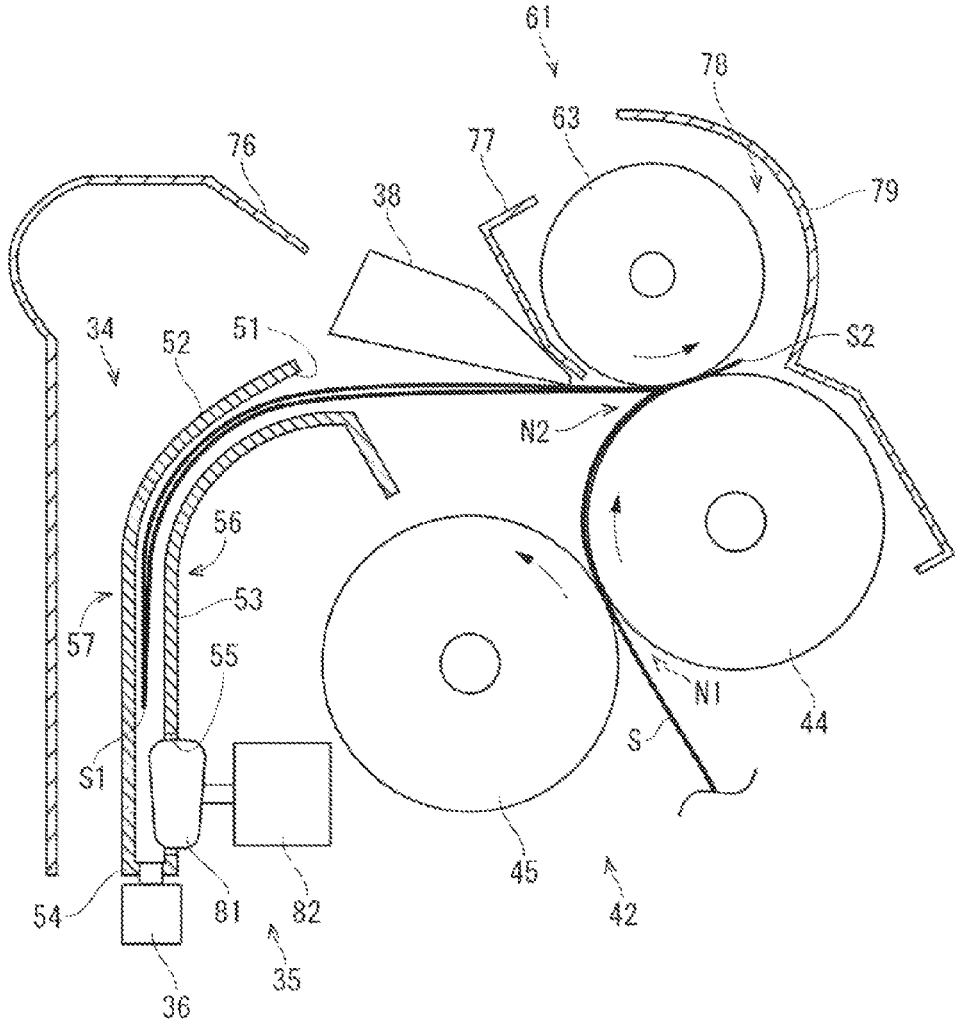
FIG. 7 is a cross-sectional view schematically illustrating a state where the second fold is formed in the sheet, the state following the process illustrated in FIG. 6.

A folding process (operation) performed on the sheet S by the sheet folding device 23 according to an embodiment will now be described with reference to FIGS. 3 and 5 to 7. Note that the process of folding the sheet S is executed by the control device 28 (see FIG. 1) included in the sheet post-processing apparatus 12. FIG. 5 is a cross-sectional view schematically illustrating a process of forming the second fold S2 in the sheet S having the first fold S1, the process following the process illustrated in FIG. 3. FIG. 6 is a cross-sectional view schematically illustrating a state following the process illustrated in FIG. 5. FIG. 7 is a cross-sectional view schematically illustrating a state where the second fold S2 is formed in the sheet S, the state following the process illustrated in FIG. 6.

First, a double folding process will be described. The double folding process is performed when the user selects the double folding mode. The destination switching member 38 turns to a position indicated by a two-dot chain line in FIG. 3, so that the destination of the sheet S having the first fold S1 formed by the first folding unit 33 is switched to the first discharge conveying path 75.

The sheet S introduced from the sheet introducing path 30 is placed on the upstream sheet holding member 31*a* and the downstream sheet holding member 31*b* and aligned by the aligning units 32. Next, as illustrated in FIG. 3, the blade member 43 of the extruding mechanism 41 sticks out and pushes the sheet S upward (in the direction D3 perpendicular to the sheet S). The sheet S pushed out by the blade member 43 enters the first nip N1 of the first folding roller pair 42 in a bent state. The sheet S that has passed through the first nip N1 has the first fold S1. After passing along the first discharge conveying path 75, the sheet S having the first fold S1 is discharged from the lower discharging unit 71 onto the lower discharge tray 39. The extruding mechanism 41 brings the blade member 43 back to the original standby position. In this manner, the folding process is continuously performed.

Next, a triple folding process will be described. The triple folding process is performed when the user selects the triple folding mode. The process performed until the first fold S1 is formed in the sheet S by the first folding unit 33 is the same as the double folding process described above, and thus will not be described here. The destination switching member 38 turns to a position indicated by a solid line in FIG. 3, so that the destination of the sheet S having the first fold S1 formed by the first folding unit 33 is switched to the retreat path 34. Thus, the sheet S having the first fold S1 is fed toward the retreat path 34. The sheet S enters the retreat path 34 from the sheet entrance 51 and moves along the curved portion 52 and the linear portion 53 while being curved. Then, the first fold S1 of the sheet S contacts the stop portion 54 of the retreat path 34 (see FIG. 5).

Even after the first fold S1 of the sheet S contacts the stop portion 54, the first folding roller pair 42 continues to be rotationally driven. Therefore, while being in contact with the inner surface of the curved retreat path 34 and the destination switching member 38, the sheet S bends to protrude toward the second nip N2 of the second folding roller pair 61 (see FIG. 6). Since the space surrounded by the common roller 44, the first roller 45, the second roller 63, the retreat path 34, and the destination switching member 38 can be used as a space where the sheet S switched back from the retreat path 34 bends, the sheet S can be smoothly bent.

The sheet S that has been bent enters the second nip N2 of the second folding roller pair 61. The sheet S that has passed through the second nip N2 has the second fold S2 (see FIG. 7). The sheet S having the second fold S2 is fed along the second discharge conveying path 78 while being wound around the periphery of the second roller 63. Then, the sheet S is discharged by the first auxiliary roller pair 62 and the lower discharging roller pair 72 from the lower discharging unit 71 onto the lower discharge tray 39.

The sheet folding device 23 according to an embodiment can perform a folding process, for example, on one to five sheets S. The thickness of one folded sheet S (having the first fold S1) is totally different from that of five folded sheets S (each having the first fold S1). Specifically, one sheet S that has been subjected to a folding process has a thickness of two sheets S, whereas five sheets S that have been subjected to a folding process have a thickness of ten sheets S. In this case, the space inside the retreat path 34 needs to accommodate the entry of sheets S having the largest thickness (i.e., ten-layer thickness in the above-described case). The same applies to the case where the thickness of the sheet S itself is changed from time to time.

However, for example, if one sheet S that has been subjected to a folding process enters the retreat path 34 that is configured to accommodate the largest thickness, the folded one sheet S may bulge and the second fold S2 may be formed at a deviated position by the second folding unit 37. Also, the first fold S1 that has contacted the stop portion 54 may move inside the retreat path 34, and the second fold S2 formed by the second folding unit 37 may be skewed.

In the sheet folding device 23 according to an embodiment, the sheet retaining mechanism 35 allows the retreat path 34 to be formed depending on the thickness of the sheet (or sheets) S that enters the retreat path 34.

The sheet retaining mechanism 35 will be described in detail with reference to FIG. 4. The sheet retaining mechanism 35 is located between the retreat path 34 and the first roller 45 of the first folding roller pair 42. The sheet retaining mechanism 35 includes the movable member 81 to be in contact with the sheet S that enters the retreat path 34, and a reciprocating mechanism 82 that moves the movable member 81 back and forth with respect to the retreat path 34.

The movable member 81 has substantially a rectangular parallelepiped shape, and faces the opening 55 that opens in the inner wall 56 of the linear portion 53 (toward the first roller 45). That is, from the inside of the curved retreat path 34, the movable member 81 comes into contact with the sheet S that has entered the retreat path 34 (linear portion 53) (see FIG. 5).

The movable member 81 is shaped to protrude toward the retreat path 34 (linear portion 53) with increasing distance from the stop portion 54 of the retreat path 34. That is, the movable member 81 is shaped such that its upper part touches the sheet S in the retreat path 34 (linear portion 53) before its lower part touches it. Therefore, the movable member 81 comes into contact with an overlapping part of the sheet S at a position slightly above the first fold S1. That is, by retaining a plurality of overlapping sheets S by concentrating a force on a point above the first fold S1, the movable member 81 can effectively reduce displacements of the sheets S. Note that the shape of the movable member 81 is not limited to that described above. For example, the upper part of the movable member 81 may be provided with a protrusion protruding toward the retreat path 34 (linear portion 53).

The reciprocating mechanism 82 is formed by a mechanism, such as a motor and rack-and-pinion mechanism or a solenoid, which linearly moves the movable member 81 back and forth. The reciprocating mechanism 82 moves the movable member 81 toward the inside and outside of the retreat path 34 (linear portion 53) through the opening 55. The reciprocating mechanism 82 may include a spring that constantly biases the movable member 81 in the direction in which the movable member 81 is pulled out through the opening 55.

The sensor 36 is formed, for example, by an optical sensor or a microswitch. The sensor 36 is attached to the stop portion 54 of the retreat path 34 and detects when the first fold S1 of the sheet S that has entered the retreat path 34 has contacted the stop portion 54. The sheet folding device 23 of this embodiment is configured such that when the sensor 36 detects the contact of the first fold S1 of the sheet S with the stop portion 54, the sheet retaining mechanism 35 starts to drive the reciprocating mechanism 82. The sensor 36 may be attached to the linear portion 53. In this case, the sensor 36 is preferably located near the stop portion 54.

The operation of the sheet retaining mechanism 35 will now be described with reference to FIG. 5. With a sensor 32*s*, the control device 28 of the sheet post-processing apparatus 12 recognizes the number, type, and thickness of sheets S placed on the upstream sheet holding member 31*a* and the downstream sheet holding member 31*b*. Note that the distance (space) between the movable member 81 and the outer wall 57 of the retreat path 34 that accommodates the number, type, and thickness of sheets S (i.e., the reciprocating position of the movable member 81) is stored in the control device 28 in advance. The control device 28 calculates the amount of movement of the movable member 81 on the basis of the recognition by the sensor 32*s*.

The triple folding process described above is performed and the sheet S having the first fold S1 enters the retreat path 34. When the sensor 36 detects that the first fold S1 has contacted the stop portion 54, the control device 28 drives the reciprocating mechanism 82 based on the recognition of the number, type, and thickness of sheets S, and moves the movable member 81 by the calculated amount of movement. Thus, the movable member 81 comes into contact with the sheet S that has entered the retreat path 34 (linear portion 53). For example, in FIG. 5, since one sheet S having the first fold S1 has entered the retreat path 34 (linear portion 53), the movable member 81 is moved in the direction indicated by a broken arrow, so that the distance between the outer wall 57 of the retreat path 34 (linear portion 53) and the movable member 81 is shortened. Then, when the movable member 81 is moved so that the movable member 81 is pulled out through the opening 55, the distance between the outer wall 57 and the movable member 81 increases. The distance between the inner wall 56 and the outer wall 57 of the retreat path 34 is the maximum value of the distance between the outer wall 57 and the movable member 81.

In an embodiment, the sheet retaining mechanism 35 can narrow or widen the space in the retreat path 34 (linear portion 53) by moving the movable member 81 in accordance with the thickness of the sheet S that enters the retreat path 34 (linear portion 53). That is, regardless of the number of sheets S or the thickness of the sheet S itself, the sheet retaining mechanism 35 can regulate the distance between the outer wall 57 and the movable member 81 to be most appropriate for the thickness of the sheet S (or bundle of sheets S) to be entered. Therefore, it is possible to reduce a bulge of the folded sheet S in the retreat path 34. It is also possible to prevent the position of the first fold S1 that has contacted the stop portion 54 from being unstable and randomly moving in the retreat path 34. That is, the behavior of the sheet S (first fold S1) in the retreat path 34 can be stabilized. Thus, the second fold S2 can be formed at a desired position without being skewed. Since the sheet S is not displaced when folded at the folds S1 and S2, the sheet S neatly folded in the desired dimensions can be obtained.

In an embodiment, the sheet S that has entered the retreat path 34 bends along the curve of the retreat path 34 (curved portion 52) and tries to move outward toward the outside of the curve. In the space surrounded by the common roller 44, the first roller 45, the second roller 63, the retreat path 34, and the destination switching member 38, the sheet S switched back from the retreat path 34 bends smoothly. From inside of the curve, the movable member 81 is brought into contact with the sheet S in a manner such that the sheet S is pushed into the retreat path 34. Therefore, bending of the sheet S toward the outside of the curve is not blocked. That is, in this space, while being in sliding contact with the inner surface of the curved retreat path 34 and the destination switching member 38, the sheet S moves along a smooth arc. Thus, the sheet S that has contacted the stop portion 54 can smoothly exit the retreat path 34, so that the second fold S2 is formed by the second folding unit 37 as desired.

Generally, the sheet S having the first fold S1 bulges at a position spaced from the first fold S1. In an embodiment, the movable member 81 is formed to protrude toward the retreat path 34 with increasing distance from the stop portion 54. Therefore, the movable member 81 comes into contact with the sheet S at a portion spaced above the first fold S1 in contact with the stop portion 54. That is, the movable member 81 comes into contact with the sheet S in a manner such that it presses the bulging portion of the sheet S. Thus, it is possible to effectively reduce the bulge of the sheet S having the first fold S1 in the retreat path 34. Also, for example, when a bundle of stacked sheets S enters the retreat path 34, the movable member 81 comes into contact with the overlapping portion of the sheets S. This can prevent displacement of the stacked sheets S.

Also in an embodiment, the sheet retaining mechanism 35 can move the movable member 81 back and forth after the sensor 36 recognizes that the first fold S1 of the sheet S has contacted the stop portion 54. Therefore, after the sheet S enters the retreat path 34 (linear portion 53), the sheet retaining mechanism 35 can reduce the bulge of the sheet S at any time. Thus, for example, since the distance between the outer wall 57 and the movable member 81 (or the space in the linear portion 53) can be kept long (or wide) so as not to block the entry of the sheet S, the sheet S can smoothly enter the retreat path 34.

In an embodiment, the sheet retaining mechanism 35 moves the movable member 81 based on the detection by the sensor 36. Alternatively, the detection by the sensor 36 may not be taken into account, or the sensor 36 may even be omitted. In this case, the movable member 81 is moved to a desired position in advance before the sheet S enters the retreat path 34 (or the linear portion 53).

The movable member 81 may be provided with a contact sensor that detects contact with the sheet S. The contact sensor is provided in an area where the movable member 81 comes into contact with the sheet S. In this case, when the sensor 36 detects that the first fold S1 of the sheet S has contacted the stop portion 54, the control device 28 drives the reciprocating mechanism 82 to move the movable member 81 toward the sheet S in the retreat path 34. Then, when the contact sensor in the movable member 81 detects the contact with the sheet S, the control device 28 stops driving the reciprocating mechanism 82.

Figure 8:
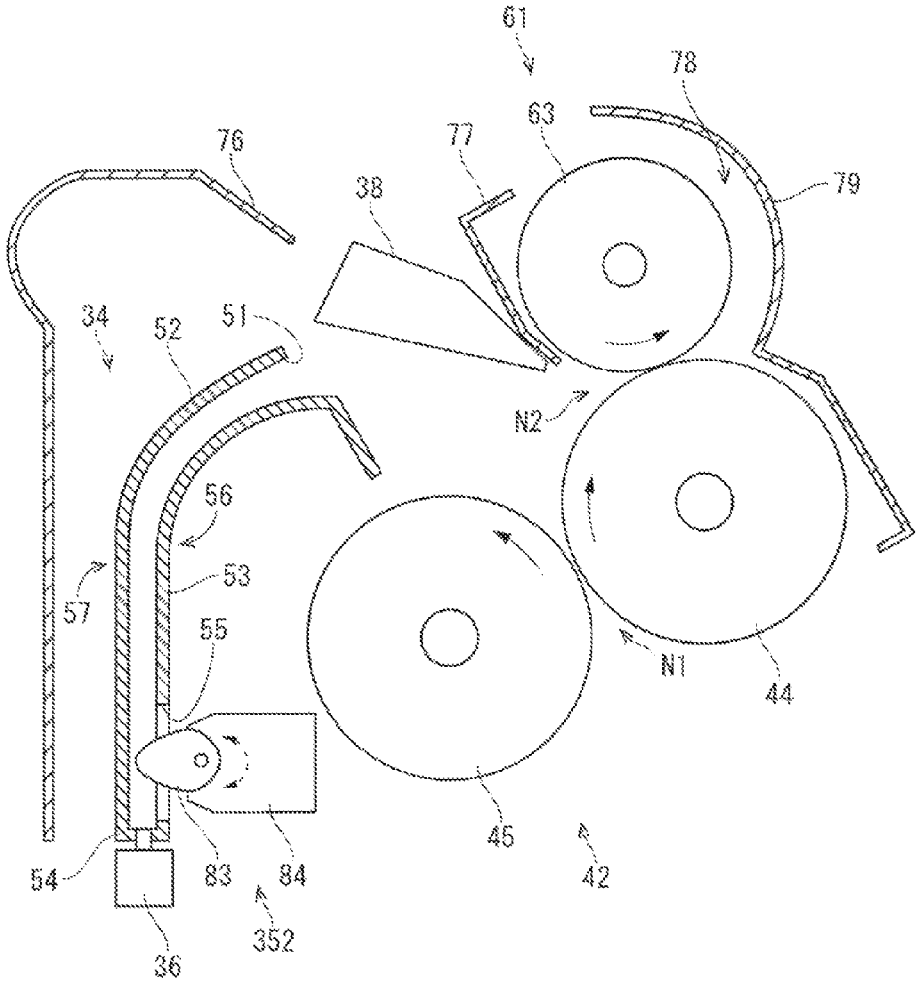
FIG. 8 is an enlarged cross-sectional view schematically illustrating a sheet folding device according to another embodiment of the present disclosure.

A sheet folding device 23 according to a second embodiment of the present disclosure will now be described with reference to FIG. 8. FIG. 8 is an enlarged cross-sectional view schematically illustrating the sheet folding device 23 according to another embodiment. In the sheet folding device 23 of this embodiment, the same components as those in the previous embodiment are given the same reference numerals and their description will be omitted.

As illustrated in FIG. 8, a sheet retaining mechanism 352 of the sheet folding device 23 according to this embodiment is formed by a cam mechanism. The sheet retaining mechanism 352 of this embodiment includes a cam 83 that comes into contact with the sheet S in the retreat path 34, and a rotational driving mechanism 84 that rotationally drives the cam 83.

The cam 83 is a so-called plate cam (peripheral cam) having an eccentric portion where the distance to the outer edge is not constant. The eccentric portion of the cam 83 is attached to a rotational shaft of the rotational driving mechanism 84. When the rotational driving mechanism 84 is driven and the cam 83 rotates, the periphery of the cam 83 is inserted through the opening 55 into the retreat path 34 and comes into contact with the sheet S in the retreat path 34 (linear portion 53). Thus, depending on the thickness of the sheet S that enters the retreat path 34 (linear portion 53), the sheet retaining mechanism 352 can change the distance between the outer wall 57 and the periphery of the cam 83 (i.e., space in the linear portion 53).

With the sheet retaining mechanism 352 of the sheet folding device 23 according to this embodiment, functional effects similar to those of the sheet retaining mechanism 35 according to the previous embodiment can be achieved. With a simple cam structure, the sheet retaining mechanism 352 can freely regulate the space in the retreat path 34 (linear portion 53) to be entered by the sheet S.

In the description above, the sheet folding devices 23 of the embodiments are applied to the cases where the double and triple folding processes are performed. The sheet folding devices 23 of the embodiments are also applicable to the cases where a folding process that folds the sheet S in four or more is performed.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A sheet folding device that performs a folding process on a sheet comprising:

a sheet holding member on which a sheet is placed;

a detector configured to detect a thickness of the sheet placed on the sheet holding member;

a first folding unit configured to form a first fold in the sheet placed on the sheet holding member;

a retreat path configured to be entered by the sheet having the first fold formed by the first folding unit, the retreat path having a stop portion to be contacted by the first fold;

a sheet retaining mechanism configured to move a movable member with respect to the sheet that enters the retreat path, the sheet retaining mechanism being configured to regulate movement of the sheet in the retreat path in a direction of thickness of the sheet; and a second folding unit configured to form a second fold in the sheet having the first fold while allowing the sheet that has contacted the stop portion to exit the retreat path, wherein the sheet retaining mechanism regulates the space in the retreat path in accordance with the thickness of the sheet that enters the retreat path.

2. The sheet folding device according to claim 1:

wherein the retreat path is curved; and in a direction from an inner wall to an outer wall that define the curved retreat path, the movable member comes into contact with the sheet that has entered the retreat path.

3. The sheet folding device according to claim 1, wherein the movable member is configured to freely move back and forth so as to come into contact with the sheet that has entered the retreat path, the movable member being formed to protrude toward the retreat path increasing distance from the stop portion of the retreat path.

4. The sheet folding device according to claim 1, wherein the movable member is a cam configured to come into contact with the sheet that has entered the retreat path.

5. The sheet folding device according to claim 1, comprising a detector configured to detect that the first fold of the sheet that has entered the retreat path has contacted the stop portion, and when the detector detects that the first fold of the sheet has contacted the stop portion, the sheet retaining mechanism moves the movable member.

6. A sheet post-processing apparatus comprising a sheet folding device that performs a folding process on a sheet comprising:

a sheet holding member on which a sheet is placed;

a detector configured to detect a thickness of the sheet placed on the sheet holding member;

a first folding unit configured to form a first fold in the sheet placed on the sheet holding member;

a retreat path configured to be entered by the sheet having the first fold formed by the first folding unit, the retreat path having a stop portion to be contacted by the first fold;

a sheet retaining mechanism configured to move a movable member with respect to the sheet that enters the retreat path, the sheet retaining mechanism being configured to regulate movement of the sheet in the retreat path in a direction of thickness of the sheet; and a second folding unit configured to form a second fold in the sheet having the first fold while allowing the sheet that has contacted the stop portion to exit the retreat path, wherein the sheet retaining mechanism regulates the space in the retreat path in accordance with the thickness of the sheet that enters the retreat path.

7. An image forming apparatus comprising a sheet folding device that performs a folding process on a sheet comprising:

a sheet holding member on which a sheet is placed;

a detector configured to detect a thickness of the sheet placed on the sheet holding member;

a first folding unit configured to form a first fold in the sheet placed on the sheet holding member;

a retreat path configured to be entered by the sheet having the first fold formed by the first folding unit, the retreat path having a stop portion to be contacted by the first fold;

a sheet retaining mechanism configured to move a movable member with respect to the sheet that enters the retreat path, the sheet retaining mechanism being configured to regulate movement of the sheet in the retreat path in a direction of thickness of the sheet; and a second folding unit configured to form a second fold in the sheet having the first fold while allowing the sheet that has contacted the stop portion to exit the retreat path, wherein the sheet retaining mechanism regulates the space in the retreat path in accordance with the thickness of the sheet that enters the retreat path.

* * * * *